United States Patent [19]

Genereaux

[11] Patent Number: 4,662,690

[45] Date of Patent: May 5, 1987

[54] FILING CABINET WITH PIVOTAL DRAWER

[76] Inventor: Eugene P. Genereaux, 7837 S. Forest St., Littleton, Colo. 80122

[21] Appl. No.: 827,822

[22] Filed: Feb. 10, 1986

[51] Int. Cl.[4] ..... A47B 88/18

[52] U.S. Cl. ..... 312/323; 312/274

[58] Field of Search ..... 312/290, 322, 323, 274, 312/273

[56] References Cited

U.S. PATENT DOCUMENTS

| | | | |
|---|---|---|---|
| 321,078 | 6/1885 | Birckhead . | |
| 788,856 | 5/1905 | Stafford | 312/290 |
| 912,328 | 2/1909 | Smithson . | |
| 1,137,074 | 4/1915 | Morris . | |
| 2,274,263 | 2/1942 | Bescherer . | |
| 2,450,337 | 9/1948 | Hearst . | |
| 2,492,871 | 12/1949 | King . | |
| 2,519,632 | 8/1950 | Brinker . | |
| 2,566,186 | 8/1951 | Gillett . | |
| 2,895,600 | 7/1959 | Nevins | 312/290 |
| 2,961,846 | 11/1960 | Federico | 312/290 |
| 3,053,603 | 9/1962 | Schapiro et al. . | |
| 3,146,048 | 8/1964 | Graham et al. | 312/323 |
| 3,320,010 | 5/1967 | Ritzerfeld | 312/323 |
| 3,814,366 | 6/1974 | Staifer . | |
| 3,975,071 | 8/1976 | Quinn . | |
| 4,314,734 | 2/1982 | Grunert . | |

*Primary Examiner*—Kenneth J. Dorner
*Assistant Examiner*—Joseph Falk
*Attorney, Agent, or Firm*—Klaas & Law

[57] ABSTRACT

A filing cabinet comprising a housing and a movable drawer therein wherein the drawer has sliding movement in a direction parallel to the bottom of the housing and pivotal movement around an axis extending between opposed side walls of the housing, parallel to the bottom of the housing and adjacent to the front of the housing and means for providing an opening in the top of the housing through which a portion of the drawer moves during the pivotal movement thereof so that the usable space within the drawer is substantially the same as the usable space in a sliding, non-pivotal drawer.

20 Claims, 6 Drawing Figures

FIG.6
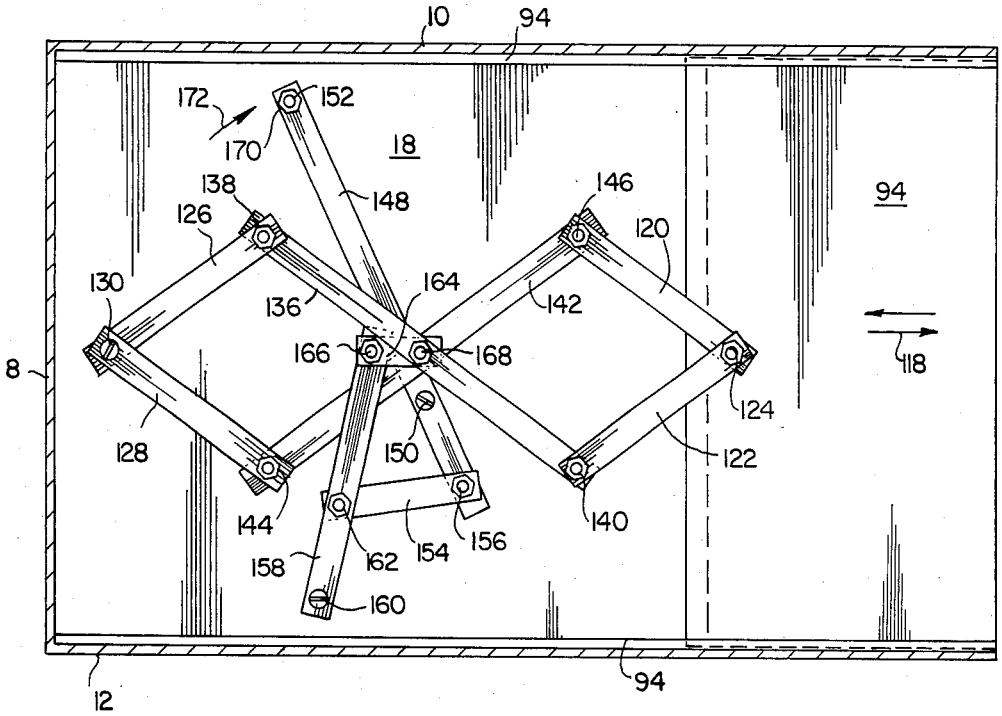
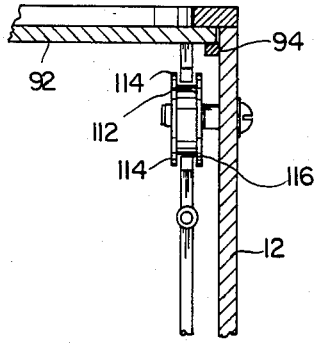
FIG. 5

FILING CABINET WITH PIVOTAL DRAWER

FIELD OF THE INVENTION

This invention relates generally to a filing cabinet having a drawer capable of movement into and out of a housing and wherein the drawer is provided with a plurality of spaced apart partitions so as to form a plurality of compartments each of which may be used for the storage of objects. More particularly, the invention relates to a filing cabinet of this nature wherein the drawer is pivotally mounted so that the filing cabinet may be mounted at a relatively high location but still have its contents readily available to a user.

BACKGROUND OF THE INVENTION

Filing cabinets comprising a housing having a drawer capable of movement into and out of the housing and wherein means are provided so that the drawer when in an opened position may be rotated around a horizontal axis have been disclosed in several patents. One of these patents is U.S. Pat. No. 3,320,010 to Ritzerfeld. In addition to the filing cabinets illustrated in FIGS. 1 and 2 of the drawing, Ritzerfeld describes in column 1, lines 20–42, two other types of filing cabinets. One of the disadvantages of these two other types of filing cabinets is that a substantial portion of the filing space must be sacrificed in order to provide for the rotation of the drawer about a horizontal axis. The filing cabinet illustrated in FIGS. 1 and 2 also sacrifices a substantial portion of the filing space in order to provide for the rotation of the drawer about a horizontal axis. In Ritzerfeld, the top plate of the housing is spaced a substantial distance above the usable space of the drawer. Thus, in the filing cabinets described above, it has been necessary to sacrifice filing space normally associated with a slidable, non-rotating drawer in order to gain the rotating function.

BRIEF DESCRIPTION OF THE INVENTION

This invention relates to a filing cabinet comprising a housing and a slidable drawer capable of movement into and out of the housing and which drawer, when in an opened position, may be pivoted about a horizontal axis so as to make the contents thereof readily accessible to the user. The filing cabinet is provided with cooperating structures which permit the utilization of filing space normally associated with a slidable, non-pivotal drawer while keeping the center of gravity adjacent to the housing. In the preferred embodiments of this invention, these desirable functions are obtained by providing means for forming an opening in the top wall of the housing through which opening at least a portion of drawer adjacent to and including the back wall thereof will move during the pivotal movement of the drawer. The housing and the drawer in the preferred embodiment are separate and distinct entities.

In one embodiment of the invention, the top wall of the housing comprise two sections. A first section is mounted in a fixed position relative to a pair of opposed side walls while a second section is pivotally mounted so that it may be moved relative to the side walls so as to provide the above-described opening. Means are provided to connect the second section of the top wall of the housing with the drawer so that as the drawer is moved toward an opened position, the second section will be pivoted in a direction away from the pair of opposed side walls to form the desired opening. Means are provided to limit the outward movement of the drawer so that the horizontal axis around which the drawer pivots is located adjacent to the front of the housing. Means are associated with means pivotally mounting the drawer so that the drawer may be locked at a plurality of different angular relationships relative to the horizontal. Additionally, means are provided for preventing inward movement of the drawer when it is in an opened an pivoted position.

In another embodiment of the invention, the second section of the top wall of the housing is mounted for sliding movement in a plane parallel to the sliding movement of the drawer. As the drawer is moved outwardly, the second section is moved inwardly to a position beneath the first section of the top wall to provide the above-desoribed opening.

It is an object of this invention to provide a filing cabinet with a slidable, pivotal drawer having substantially the same size and filing capacity as a filing cabinet having a slidable, non-pivotal drawer while keeping the center of gravity adjacent to the housing of the filing cabinet.

Additional objects, advantages and novel features of the invention are set forth in part in the description which follows which will be understood by those skilled in the art upon examination of the following or may be learned by practice of the invention. The objects and advantages of the invention may be realized and obtained by means of the instrumentalities and combinations particularly pointed out in the appended claims.

BRIEF DESCRIPTION OF THE DRAWING

FIG. 5 is an enlarged view of a guide means of FIG. 3; and

FIG. 6 is a bottom plan view of the top wall of another embodiment of the invention.

DETAILED DESCRIPTION OF THE INVENTION

Figure 1:
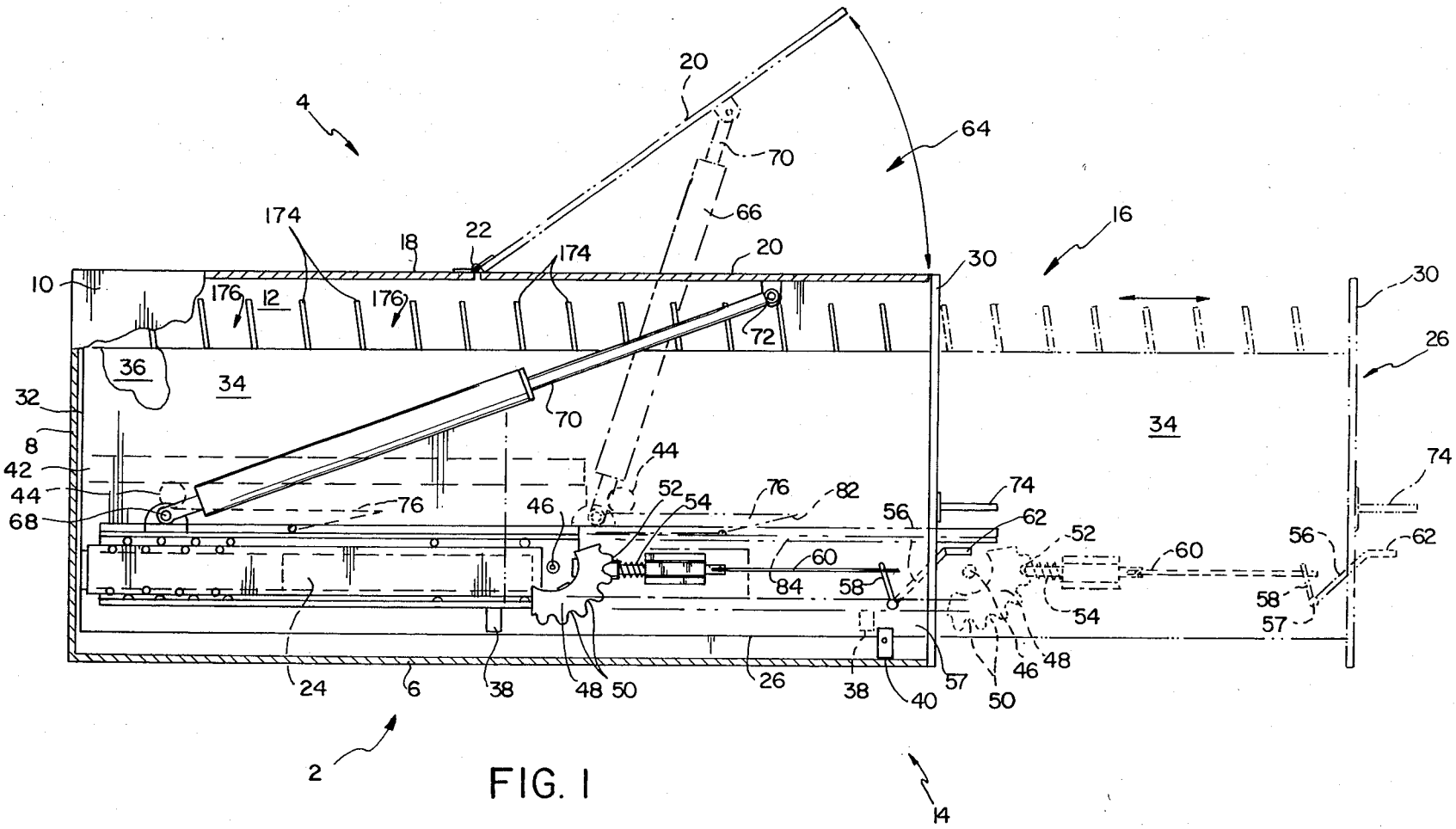
FIG. 1 is a side elevational schematic illustration of one embodiment of the invention.
Figure 2:
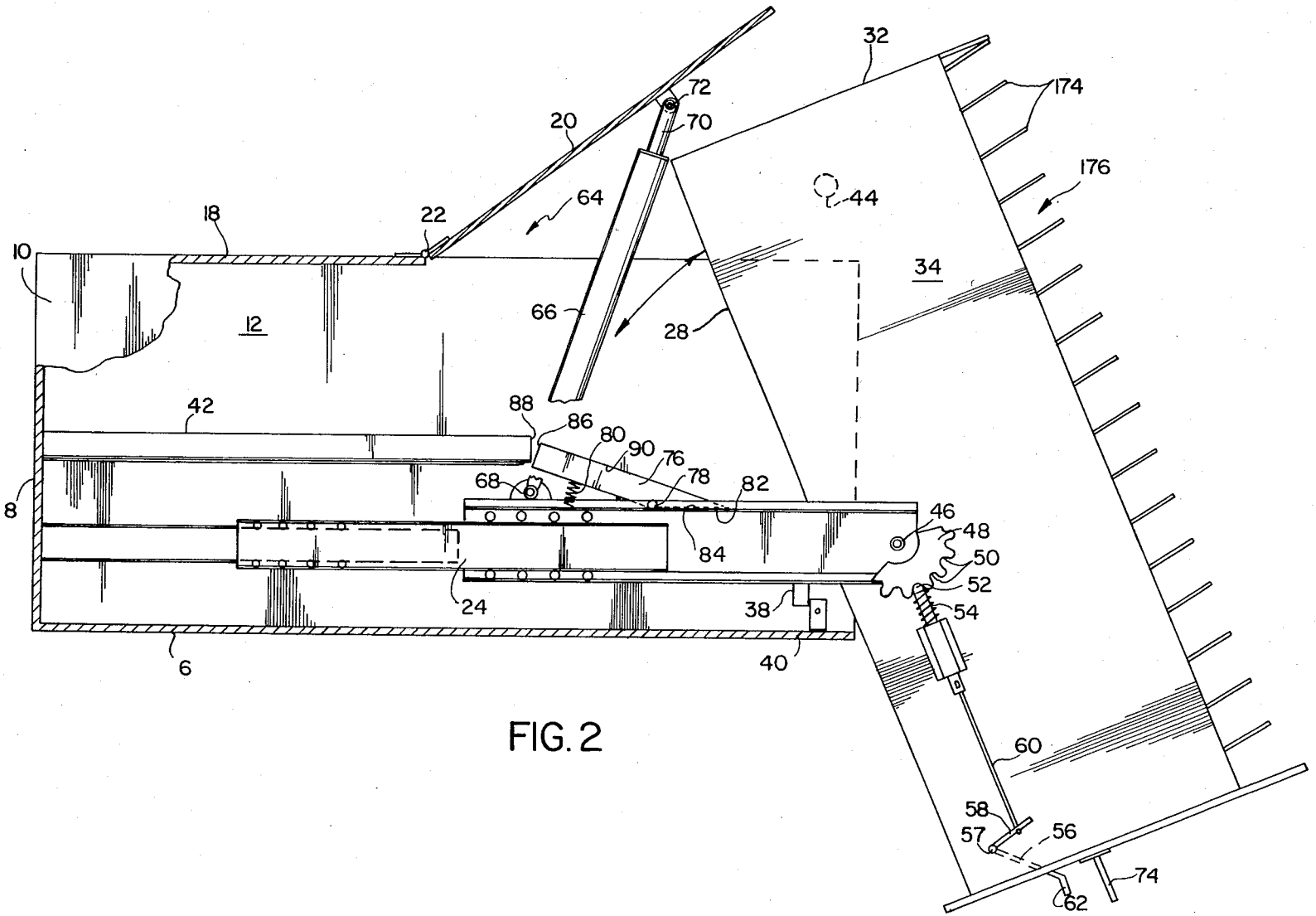
FIG. 2 is a view similar to FIG. 1 with the drawer in a pivoted position.

One embodiment of the invention is illustrated in FIGS. 1 and 2 and comprises a housing 2 having a top wall 4, a bottom wall 6, a back wall 8 and side walls 10 and 12. The front wall 14 of the housing 2 comprises the ends of the top, bottom and side walls so as to form an opening 16 into the housing 2. The top wall 4 of the housing 2 comprises a first section 18 which is in a fixed position relative to the back wall 8 and the side walls 10 and 12 and may be secured thereto and a second section 20 which is pivotally secured to the first section 18 by suitable means, such as the hinge 22. A conventional drawer slide means 24 is mounted on the inner surfaces of each of the side walls 10 and 12 so that the drawer 26 may be moved into and out of the housing 2.

The drawer 26 comprises a bottom wall 28, a front wall 30, a back wall 32 and a pair of opposed side walls 34 and 36 is mounted on the drawer slide means 24 for movement into and out of the housing 2. The stop member 40 may be secured at other locations such as the side walls 10 or 12 and the lug 38 may be at other locations as long as they are relative locations to limit the movement of the drawer 26 out of the housing 2. A lug 38 on the drawer slide means 24 abuts against a stop member 40 secured to the bottom wall 6 of the housing 2 to limit movement of the drawer 26 out of the housing 2. A rail 42 secured to at least one of the side walls 10 or 12 functicns to counterbalance the drawer 26 and to guide it in its sliding movement. A roller 44 is mounted on at least one of the side walls 34 or 36 for contact with and movement over the rail 42.

The drawer 26 is pivotally mounted on at least one of the drawer slide means 24 by the pivot means 46 and preferably is pivotally mounted on each of the drawer slide means 24 by a pivot means 46. As illustrated in FIG. 1, the pivot means 46 are located a substantial distance above the bottom 6 of the housing 2 to provide for easier pivotal movement of the drawer by better distribution of the weight thereof. A plate 48 having a plurality of notches 50 in the periphery thereof is mounted in a fixed position on at least one of the drawer slide means 24. A movable pin 52 is mounted on the side wall 34 of the drawer 26 and is urged by the spring 54 toward the plate 48. As illustrated in Figs. 1 and 2, the pin 52 is shaped so as to fit into each of the notches 50. A generally V-shaped lever 56 is pivotally mounted on pivot means 57 mounted on the side wall 34. One side 58 of the lever 56 is connected to a member 60 which extends from the pin 52 and the other side 62 of the lever 56 extends through a slotted opening in the front wall 30 of the drawer. When a sufficient force is applied to the other side 62, the lever 56 will pivot, pull the pin 52 away from the plate 48 and the notches 50 so that the drawer 26 may be pivoted about the pivot means 46. When the drawer reaches the desired angular relationship, such as that illustrated in FIG. 2, the force is removed from the other side 62 of the lever 56 and the spring 54 urges the pin 52 into a notch 50 so as to hold the drawer 26 at the desired angular relationship. The notches 50 may be spaced apart to provide as many angular relationships as desired. In the embodiment illustrated in FIGS. 1 and 2, the drawer 26 may be placed in angular relationships of 0 degrees, 22.5 degrees; 45 degrees, 67.5 degrees and 90 degrees to the horizontal.

In accordance with the invention, suitable means are provided to pivot the second section 20 of the top wall 4 of the housing 2 around the pivot 22 so as to provide an opening 64 through which the back wall 32 and portion of the side walls 34 and 36 will pass as the drawer 26 is rotated about the pivot means 46. One such means is illustrated in FIGS. 1 and 2 and comprises a cylinder 66 pivotally mounted on the drawer slide means 24 by pivot means 68 and a rod 70 slidable into and out of the cylinder 66 and pivotally mounted to the second section 20 by pivot means 72. Thus, as the drawer 26 is moved out of and into the housing 2, the piston 70 and cylinder 66 move the second section 20 to an opened or closed position. It is understood that other means may be utilized to move the second section 210 to an opened or closed position. A handle 74 is provided on the front wall 30 for use in moving the drawer 26 as desired.

Means are provided to prevent inward movement of the drawer 26 when it is in an angular relationship greater than zero degrees. As illustrated in FIGS. 1 and 2, such means comprises a member 76 pivotally mounted on the drawer slide means 24 by pivot means 78 and urged outwardly therefrom by a spring 80. Outward movement of the member 76 is limited by contact between a surface 82 thereof and a surface 84 on the drawer slide means 24. Inward movement of the drawer 26 is prevented by contact between the end surface 86 on the member 76 and the end surface 88 on the rail 42. As the drawer 26 is moved back into an angular relationship of zero degrees, the roller 44 contact the surface 90 on the member 76 to push the member 76 into the relationship illustrated in FIG. 1.

Figure 3:
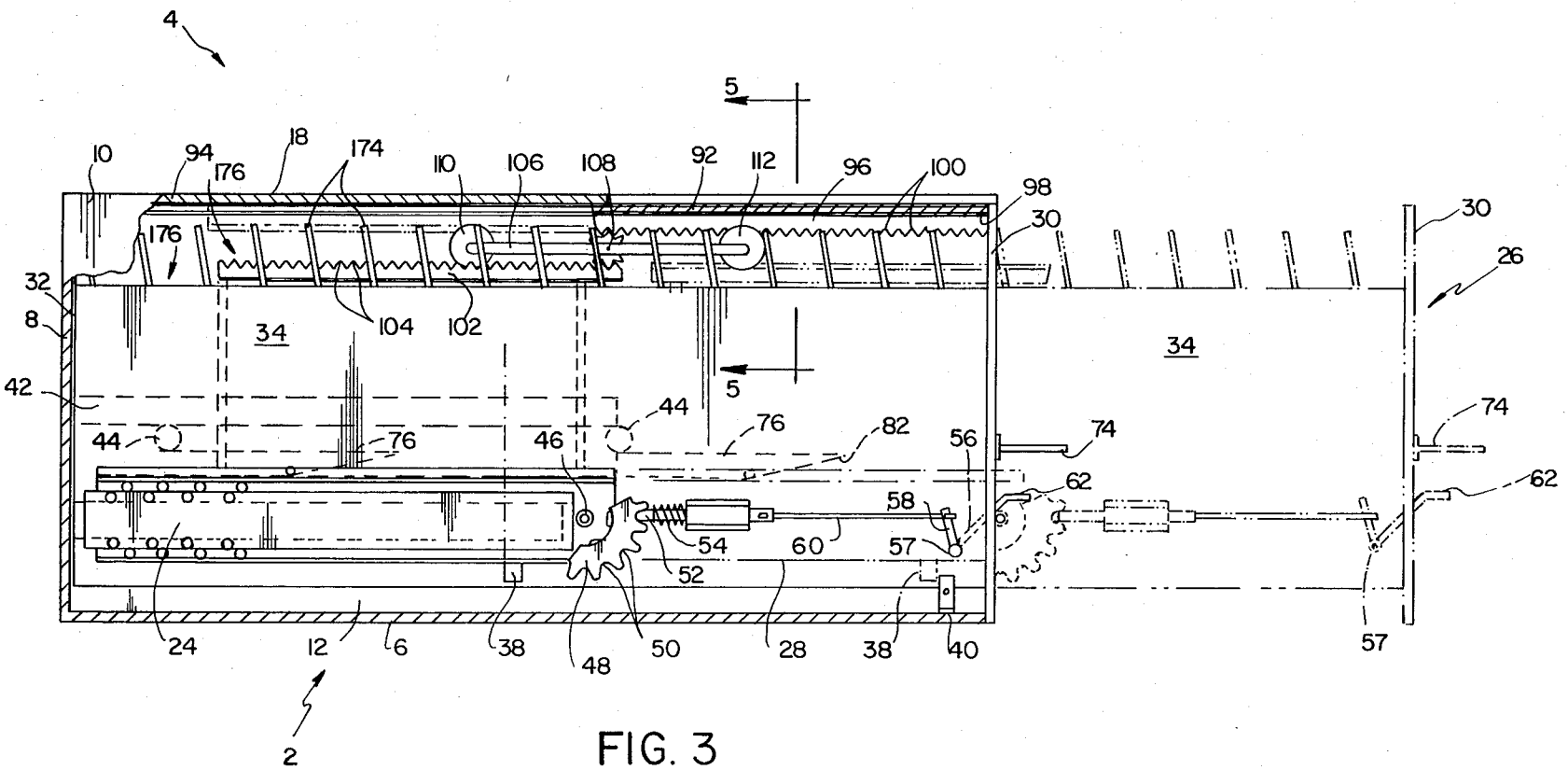
FIG. 3 is a side elevational schematic illustration of another embodiment of the invention.
Figure 4:
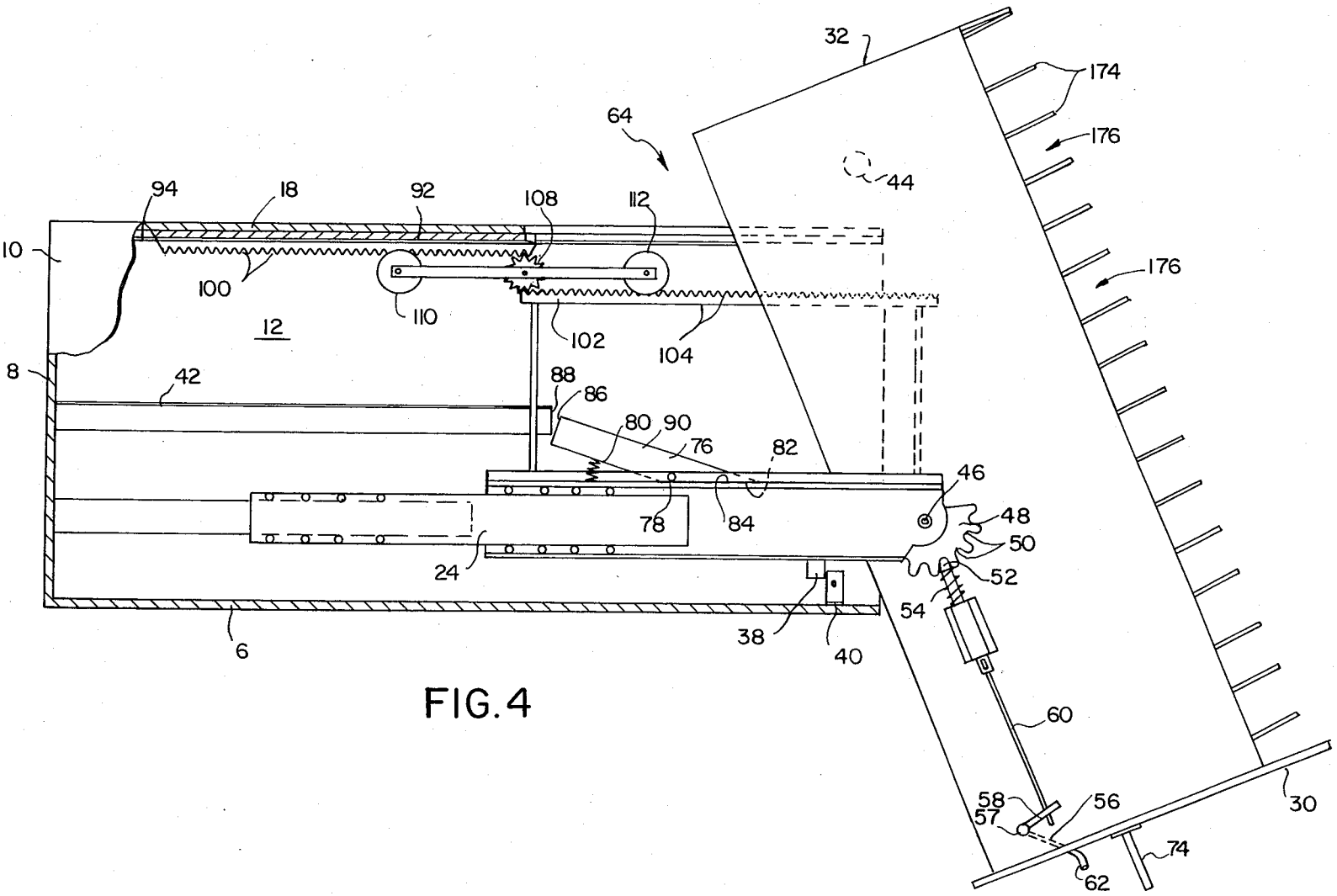
FIG. 4 is a view similar to FIG. 3 with the drawer in a pivoted position.

The embodiment of the invention illustrated in FIGS. 3 -5 has structures and functions similar to those described above in relation to FIGS. 1 and 2. The description of these structures and functions will not be repeated but corresponding reference numerals are used to identify the similar structures.

As illustrated in FIG. 3, the second section 92 of the top wall 4 of this embodiment is mounted for sliding movement parallel to but opposite to the direction of movement of the drawer 26. A rail 94 is mounted on the inner surface of each of the side walls 10 and 12 of the housing 2. A portion of the second section 92 adjacent to each of the side walls 10 and 12 is supported by the rails 94 for sliding movement thereover. A rack 96 is mounted on the bottom surface 98 of the second section 92 and has a plurality of spaced apart teeth 100. Another rack 102 is mounted on the drawer slide means 24 and has a plurality of spaced apart teeth 104. An elongated member 106 is secured to the side wall 12 and a rotatable gear 108 is mounted thereon adjacent to the center thereof. A rotatable wheel 110 and 112 is mounted on the elongated member 108 adjacent to each end thereof. As illustrated in FIG. 5, each wheel has a central recess therein so as to form a pair of flanges 114 and 116 which straddle the teeth 100 or 104 so as to guide the movement of the racks 96 and 102. As the drawer 26 is moved outwardly, as illustrated in FIG. 3, the gear 108 is rotated by the teeth 104 of the rack 102 and the rotating gear 108 engages the teeth 110 of the rack 106 so as to move the second section 92 over the rails 94 into a position beneath the first section 18.

In FIG. 6, there is illustrated another means for moving the second section in directions indicated by the arrows 118. A pair of arms 120 and 122 are pivotally connected together by a pivot means 124 mounted in a fixed position on the second section 92. Another pair of arms 126 and 128 are pivotally connected together by a pivot means 130 mounted in a fixed position on the one section 18. An arm 136 is pivotally connected at one end to the arm 126 by the pivot means 138 and is pivotally connected at its other end to the arm 122 by the pivot means 140. An arm 142 is pivotally connected at one end to the arm 128 by the pivot means 144 and is pivotally connected at its other end to the arm 120 by the pivot means 146. An arm 148 is pivotally mounted on a pivot means 150 mounted in a fixed position on the one section 18. One end of the arm 148 is pivotally connected by the pivot means 152 to a member (not shown) mounted on the drawer slide means 24 for movement therewith. At its other end, the arm 148 is pivotally connected to the arm 154 by the pivot means 156. An arm 158 is pivotally mounted on a pivot means 160 mounted in a fixed position on the one section 18. The arm 158 is pivotally connected to the arm 154 by the pivot means 162. The arm 158 is pivotally connected to one end of an arm 164 by pivot means 166. The other end of the arm 164 is pivotally connected to each of the arms 136 and 142 by pivot means 168. When the drawer 26 is pulled outwardly, the end 170 of the arm 148 will move in the direction of the arrow 172 and will pivot around the pivot means 150. This movement will move pivot means 156 toward the back wall 8 to move the arm 154 and the pivot means 162 and arm 158 toward the back wall 8. The movement of the arm 158 causes movement of the arm 164 through the pivot means 166 toward the back wall 8. The movement of the arm 164 acting through the arms 136, 142, 120 and 122 and pivot connections 168, 146, 140 and 124 causes the second section to move toward the back wall 8.

As illustrated in FIGS. 1–4, the drawer 26 is provided with a plurality of partitions 174 so as to form a plurality of compartments 176 in the drawer 26. The partitions are illustrated to be at an angle of about 15 degrees to the vertical. However, in view of the ability to hold the drawer 26 in any desired relationship, the partitions 174 can be located in a vertical position so that all of the drawer space can be utilized.

The structures described above provide a sliding, pivotal drawer having a usable space substantially the same as a sliding, non-pivotal drawer since the top of the drawer may be located close to the top of the housing and at the same time being able to have the pivot axis located adjacent to the housing to provide for locating the center of gravity of the drawer when in an opened angular relationship at a preferred location.

It is contemplated that the inventive concepts herein described may be variously otherwise embodied and it is intended that the appended claims be construed to include alternative embodiments of the invention except insofar as limited by the prior art.

What is claimed is:

1. A filing cabinet comprising:

a housing;

said housing comprising a pair of opposed side walls, a top wall, a bottom wall, a back wall and a front wall;

said front wall having an opening therein;

a drawer;

said drawer comprising a pair of opposed side walls, a bottom wall, a back wall, a front wall and a top wall having at least an opening therein;

said top wall of said housing being located above and substantially parallel to said top wall of said drawer when said drawer is in a closed position;

means for mounting said drawer for sliding movement relative to said housing into and at least partially out of said housing through said opening in said front wall, said sliding movement being in a plane parallel to said bottom wall of said housing;

means for mounting said drawer for pivotal movement about an axis extending between said opposed side walls of said drawer and parallel to said bottom wall of said drawer when said drawer has been moved to an open position;

means for forming an opening in said top wall of said housing through which opening at least a portion of said drawer adjacent to and including said back wall thereof will move during said pivotal movement of said drawer; and said means for mounting said drawer for pivotal movement being located so that at least a major portion of said back wall of said drawer will move through said opening formed in said top wall of said housing during said pivotal movement thereof.

2. A filing cabinet as in claim 1 wherein:

said bottom wall of said drawer is located slightly above said bottom wall of said housing; and said means for mounting said drawer for pivotal movement is located a substantial distance above said bottom wall of said housing.

3. A filing cabinet as in c1aim 2 and further comprising:

the usable space in said drawer being substantially the same as the usable space of a sliding, non-pivotal drawer.

4. A filing cabinet as in claim 1 wherein said top wall of said housing comprises:

a first section mounted in a fixed position relative to said pair of opposed side walls and said back wall of said housing;

a second section; and means responsive to said sliding movement of said drawer for providing movement of said second section relative to said first section so as to form said opening in said top wall of said housing.

5. A filing cabinet as in claim 4 and further comprising:

pivot means for pivotally connecting said first and second sections so that said relative movement is pivotal.

6. A filing cabinet as in claim 5 and further comprising:

a cylinder;

a rod mounted for movement into and out of said cylinder;

means, at a fixed location on said means for mounting said drawer of sliding movement, for pivotally mounting one end of said cylinder thereto; and means, at a fixed location on said second section of said top wall, for pivotally mounting one end of said rod so that as said drawer moves out of said housing said rod applies a force to said second section to cause pivotal movement of said second section in a direction away from said bottom wall of said housing so as to form said opening in said top wall of said housing.

7. A filing cabinet as in claim 6 wherein said means for mounting said drawer for sliding movement comprises:

a first means mounted between the side wall of said housing and the side wall of said drawer on one side of said filing cabinet; and a second means mounted between the side wall of said housing and the side wall of said drawer on the other side of said filing cabinet.

8. A filing cabinet as in claim 7 wherein said means for mounting said drawer for pivotal movement comprises:

a member mounted on said each of said first and second means for mounting said drawer for sliding movement; and means pivotally mounting said drawer to each of said members.

9. A filing cabinet as in claim 8 and further comprising:

means for locking said drawer at various angular relationships around its pivotal axis.

10. A filing cabinet as in claim 9 wherein said locking means comprises:

at least one member mounted in a fixed position;

a plurality of spaced apart notches in a peripheral surface of said member;

a pin mounted on an adjacent side wall of said drawer;

means for urging said pin for movement toward said at least one member and into one of said notches so as to prevent pivotal movement of said drawer; and means for applying a force to pull said pin out of said one of said notches to allow for pivotal movement of said drawer.

11. A filing cabinet as in claim 10 and further comprises means for preventing sliding movement of said drawer into said housing when said drawer has been pivoted about its pivotal axis.

12. A filing cabinet as in claim 4 and further comprising:

means for limiting said sliding movement of said drawer relative to said housing in a direction out of said housing; and means for permitting said pivotal movement of said drawer only when said sliding movement of said drawer out of said housing has been limited.

13. A filing cabinet as in claim 12 wherein:

said both wall of said drawer is slightly above said bottom wall of said housing; and said means for mounting said drawer for pivotal movement is located a substantial distance above said bottom wall of said housing.

14. A filing cabinet as in claim 4 and further comprising:

means for preventing sliding movement of said drawer into said housing when said drawer has been pivoted about its pivota1 axis.

15. A filing cabinet as in claim 4 wherein:

said relative movement is a sliding movement in a plane parallel to said bottom wall of said housing.

16. A filing cabinet as in claim 15 and further comprising:

means on the inner surface of each of said opposed side walls of said housing for forming a support surface having portions thereof located adjacent to said first section. and said second section; and means for moving said second section in a reciprocal path over said support surfaces.

17. A filing cabinet as in claim 16 wherein said means for moving said second section comprises:

a first rack having teeth is mounted at a fixed location on the inner surface of said second section adjacent to one of said pairs of opposed side walls of said housing;

a second rack having teeth is mounted at a fixed location on said means for mounting said drawer for sliding movement relative to said housing; and a rotatable gear having teeth is mounted at a fixed location on said one of said pair of opposed side walls of said housing with the teeth of said gear being in engagement with the teeth of said first rack and the teeth of said second rack so that movement of said drawer in one direction causes movement of said second section in an opposite direction.

18. A filing cabinet as in claim 15 and further comprising:

means for limiting said sliding movement of said drawer relative to said housing in a direction out of said housing; and means for permitting said pivotal movement of said drawer only when said sliding movement of said drawer out of said housing has been limited.

19. A filing cabinet as in claim 18 wherein:

said bottom wall of said drawer is slightly above said bottom wall of said housing; and said means for mounting said drawer for pivotal movement is located a substantial distance above said bottom wall of said housing.

20. A filing cabinet as in claim 19 and further comprising:

means for preventing sliding movement of said drawer into said housing when said drawer has been pivoted about its pivotal axis.

* * * * *

UNITED STATES PATENT AND TRADEMARK OFFICE

CERTIFICATE OF CORRECTION

PATENT NO. : 4,662,690

DATED : May 5, 1987

INVENTOR(S) : Eugene P. Genereaux

It is certified that error appears in the above-identified patent and that said Letters Patent is hereby corrected as shown below:

Column 3, line 59, cancel "210" and insert therefor --20-- column 7, line 21, cancel "both" and insert therefor --bottom--

Signed and Sealed this

Twenty-fifth Day of August, 1987

*Attest:*

DONALD J. QUIGG

*Attesting Officer*

*Commissioner of Patents and Trademarks*